US009498698B2

(12) United States Patent
Gelin et al.

(10) Patent No.: US 9,498,698 B2
(45) Date of Patent: Nov. 22, 2016

(54) ADJUSTING ASSEMBLY COMPRISING A RETAINING LINK AND A BLOCKING DEVICE FOR KEEPING A SHOE ON A SPORTS APPARATUS

(71) Applicant: Skis Rossignol, Saint-Jean de Moirans (FR)

(72) Inventors: Vincent Gelin, Grenoble (FR); Florence Mandon, La Murette (FR); Adrien Reguis, Grenoble (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 0 days.

(21) Appl. No.: 14/971,518

(22) Filed: Dec. 16, 2015

(65) Prior Publication Data

US 2016/0175688 A1 Jun. 23, 2016

(30) Foreign Application Priority Data

Dec. 19, 2014 (FR) ..... 14 62951

(51) Int. Cl.
*A63C 10/06* (2012.01)
*A63C 5/03* (2006.01)

(52) U.S. Cl.
CPC *A63C 10/06* (2013.01); *A63C 5/03* (2013.01)

(58) Field of Classification Search
CPC ..... A43C 11/14–11/1493; A44B 11/065; A63C 11/065
See application file for complete search history.

(56) References Cited

U.S. PATENT DOCUMENTS 3,662,435 A * 5/1972 Allsop ..... A43C 11/1413 24/70 SK
4,501,354 A * 2/1985 Hoffman ..... A47K 5/00 206/499

(Continued)

FOREIGN PATENT DOCUMENTS

EP 1 118 361 A 7/2001
EP 1 238 597 A 9/2002

(Continued)

OTHER PUBLICATIONS

Search Report issued by French Patent Office for priority French application 1462951 dated Sep. 28, 2015.

*Primary Examiner* — Erez Gurari
(74) *Attorney, Agent, or Firm* — Frommer Lawrence & Haug LLP

(57) ABSTRACT

The invention relates to an adjusting assembly designed to retain a shoe on a sports apparatus comprising a retaining link (8) and a blocking device (12), this retaining link having a fastening point (14) at one of these ends and a free end (13) at the other end designed to be inserted into the blocking device (12), the retaining link (8) including notching elements (16) designed to cooperate with the blocking device (12) when it is in the locking position in order to adjust the length of the retaining link (8), characterized in that the notching elements (16) are made up of at least two hollows zones (16*a*, 16*b*) distributed on either side of a longitudinal stiffening zone (17) of the retaining link (8) and in that the blocking device (12) comprises a lever (19) articulated around an axis (d) and including two blocking elements (22*a*, 22*b*) that cooperate with said hollow zones (16*a*, 16*b*), respectively, of the retaining link (8) in its locking position.

12 Claims, 3 Drawing Sheets

(56) References Cited

U.S. PATENT DOCUMENTS 4,922,582 A * 5/1990 Flanigan ..... A44B 11/065 24/198
5,745,959 A * 5/1998 Dodge ..... A43C 11/00 24/68 SK
5,745,963 A * 5/1998 Graziano ..... A43B 1/0072 24/68 SK
6,374,464 B1 * 4/2002 Lai ..... A43C 11/1406 24/68 SK
6,431,423 B1 * 8/2002 Allen ..... B60R 9/048 224/324
6,561,398 B1 * 5/2003 Cole ..... B60R 9/048 224/324
6,684,667 B2 * 2/2004 Young ..... A41F 1/008 70/18
6,859,981 B2 * 3/2005 Hsiao ..... A43C 11/1406 24/68 SK
7,802,808 B2 * 9/2010 Neiley ..... A63C 10/06 280/623
D630,419 S * 1/2011 Torrance ..... D2/946
8,869,354 B2 * 10/2014 Horimoto ..... A42B 3/08 24/69 ST
9,155,359 B1 * 10/2015 Bailey ..... A44B 11/065
9,277,776 B2 * 3/2016 Laatz ..... A44B 11/125
2002/0000707 A1 * 1/2002 Couderc ..... A43C 11/1406 280/611
2002/0010987 A1 * 1/2002 Caeran ..... A43C 11/148 24/712
2002/0011718 A1 * 1/2002 Couderc ..... A63C 10/18 280/623
2002/0084604 A1 * 7/2002 Phillips ..... A43C 11/1413 280/14.21
2002/0173739 A1 * 11/2002 Jensen ..... A43B 7/1495 602/27
2004/0128803 A1 * 7/2004 Draper ..... A43C 11/1486 24/68 SK
2008/0054600 A1 * 3/2008 Caslowitz ..... A43B 5/16 280/619
2010/0162539 A1 * 7/2010 Rancon ..... A43C 11/1453 24/70 ST
2010/0295269 A1 * 11/2010 Krenn ..... A63C 10/06 280/633
2011/0099846 A1 * 5/2011 Fischer ..... A43B 5/0433 36/117.1
2013/0031702 A1 * 2/2013 Gafforio ..... A42B 3/08 2/421
2013/0042446 A1 2/2013 Tseng
2013/0047388 A1 * 2/2013 Kavarsky ..... A43C 11/1413 24/68 SK
2014/0007464 A1 * 1/2014 Bird ..... A43C 11/146 36/131
2014/0157626 A1 * 6/2014 Briggs ..... A43C 11/146 36/83

FOREIGN PATENT DOCUMENTS

FR 2820049 A 1/2001
FR 2925345 A 6/2009

* cited by examiner

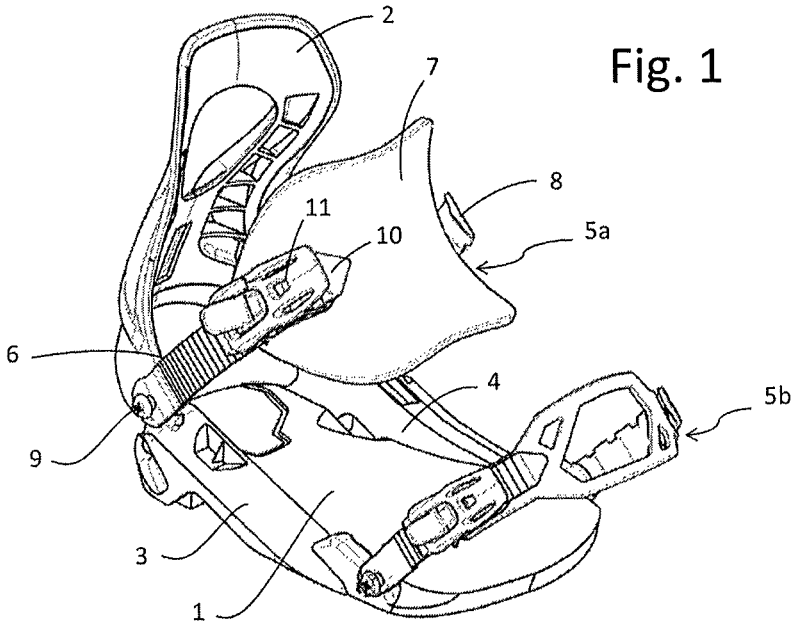
Fig. 1
Fig. 2
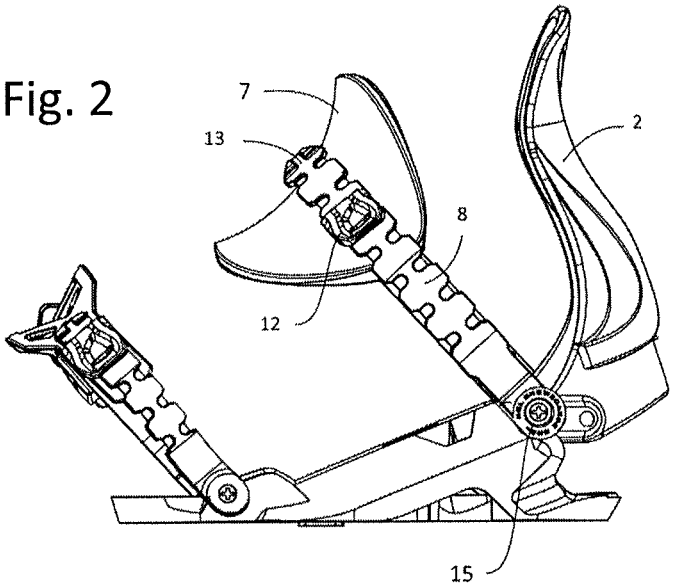

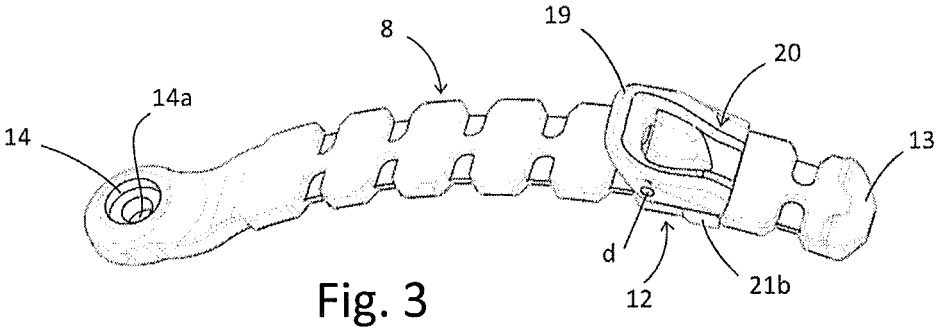
Fig. 3
Fig. 4
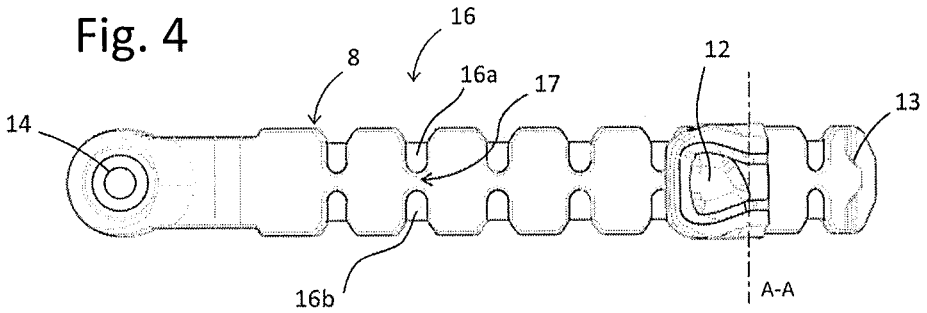
Fig. 5
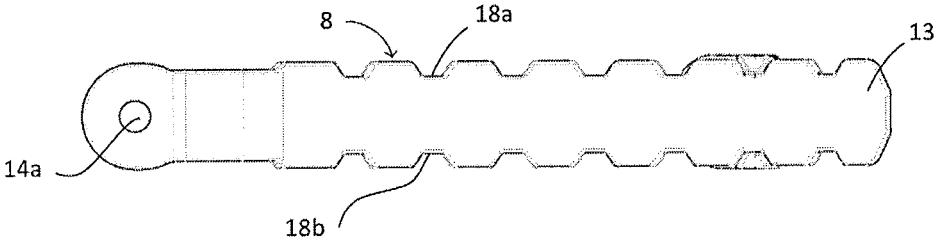

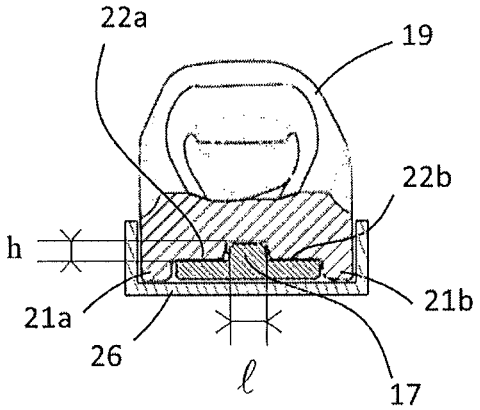
Fig. 6
Fig. 7
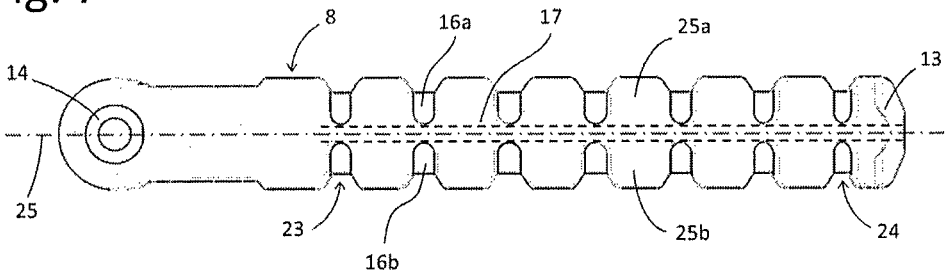
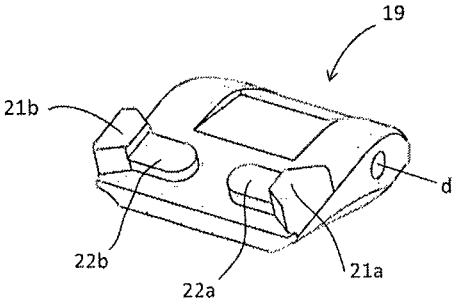
Fig. 8

ADJUSTING ASSEMBLY COMPRISING A RETAINING LINK AND A BLOCKING DEVICE FOR KEEPING A SHOE ON A SPORTS APPARATUS

The invention relates to an adjusting assembly designed to retain a shoe on a sports apparatus comprising a retaining link and a blocking device connected to a maintaining strap. The maintaining strap makes it possible to cover an upper part of the shoe to keep the shoe against a base of a device for fastening a shoe on a sports apparatus, the sports apparatus in particular being a sliding apparatus.

This assembly makes it possible to adjust the length of the retaining link in order to adapt it to the shoe and improves the maintenance and tightening thereof on the sports apparatus.

This assembly is particularly suitable for maintaining a shoe on a board for gliding on snow, in particular a snowboard, receiving both of a user's feet, or for maintaining a foot directly, optionally equipped with a boot sock, on a board for gliding on water.

Commonly, a snowboard fastener comprises a base on which the sole of the shoe rests, this base including side walls. At least one retaining or tightening link for a foot or shoe is attached on one of the walls. Such a device is for example described in patent FR 2,820,049. The snowboard fastening base includes at least one maintaining strap often Made up of three parts: a first retaining link fastened to the first lateral side of the base by a fastening point, a covering portion for an upper portion of the foot, and a second retaining link fastened to the second lateral side of the base by a second fastening point.

The first retaining link and the second retaining link are each connected to the central covering portion by two separate locking devices situated on either side of the covering portion. The length of each of the retaining links can be adjusted relative to the covering portion, and the retaining element is fixed in the chosen position using the blocking device cooperating therewith, which has the advantage of centering the covering portion relative to the lateral sides of the base and vertically adjusting the strap to the length of the shoe.

In general in the prior art, two types of adjusting assembly formed by a retaining link in the form of a strip and a blocking device make it possible to adjust the length of this link.

In a first type, as illustrated in document FR 2,820,049, the retaining link in the form of a strip has notching elements formed by a series of teeth distributed over the length of the strip, each of the teeth being formed over the entire width of the strip, the teeth being designed to cooperate with a longitudinal blocking device of the loop type including an articulated lever. This type of link is commonly called a rack.

In a second type, as illustrated in document EP 1,118,361, the retaining link is made up of a strip provided with holes designed to cooperate with a securing screw.

The retaining link of the rack type has the drawback of having a large number of longitudinal positions that are not necessary, primarily to position the retaining element longitudinally on the shoe on the inner side of the fastening base that is situated on the inner side of the user's foot and which do not allow the user to find the preferred position easily in which his foot will be maintained correctly in the base of the fastener by the maintaining strap. In addition, the teeth being very fine, the blocking element cooperates with the hollows situated between two teeth over a very small surface, this surface bearing very high pressures, which presents risks of damage and even breakage of the rack. These many transverse teeth also weaken the strength of the rack in terms of flexion, this rack being very stressed when it is separated from the base to allow the insertion of the shoe into the base of the fastener.

The retaining link, which has adjusting holes that cooperate with a screw, does not allow the user to perform a quick and practical adjustment without any risk of losing the blocking element.

Consequently, to resolve these drawbacks, the aim of the invention is to propose a particular geometry of the retaining link that makes it possible to reduce the number of longitudinal adjusting positions so that the user can easily identify the adjustment position that suits him best, by proposing a retaining element that remains flexible while improving its mechanical strength, and thereby avoiding premature breakage of this retaining link.

Another aim of the invention is to propose a blocking device that is easy to unlock, adapted to the specificity of the retaining link, that allows a good distribution of the forces exerted by the blocking device over a large area of the retaining link to avoid untimely breakages.

Another aim is to improve the lateral maintenance of this retaining link within the blocking device.

The invention proposes an adjusting assembly designed to retain a shoe on a sports apparatus comprising a retaining link and a blocking device, this retaining link having a fastening point at one of these ends and a free end at the other end designed to be inserted into the blocking device, the retaining link including notching elements designed to cooperate with the blocking device when it is in the locking position in order to adjust the length of the retaining link.

The invention is characterized in that the notching elements are made up of at least two hollows zones distributed on either side of a stiffening zone positioned near the longitudinal axis of symmetry of the retaining link.

According to advantageous optional aspects of the invention, the adjusting assembly according to the invention may incorporate one or more of the following features, considered in any technically admissible combination.

The adjusting assembly can comprise a stiffening zone situated in the central portion of the retaining link around its longitudinal axis of symmetry.

This stiffening zone can extend continuously from the first adjusting position to the last adjusting position and can be extended by two lateral fins (25*a*, 25*b*) on either side thereof each situated between two successive hollows.

The width of these fins can be greater than the width of the hollows zones.

According to another aspect of the invention, the adjusting assembly includes a blocking device that is made up of a lever articulated around an axis secured to the base of this blocking device, this lever including two blocking elements that cooperate with the hollow zones of the retaining link distributed on either side of the stiffening zone in the locking position in one of the positions of the retaining link.

This blocking device may include centering teeth on either side of the blocking elements that are positioned on either side of the hollow zones of the retaining link in the locking position of the blocking device.

The retaining link can then include lateral recesses formed on the lateral sides of the retaining link and that are designed to receive the centering teeth of the blocking device.

The invention also relates to a device for maintaining the shoe on a sports apparatus provided with the adjusting assembly according to the invention, as well as a gliding board equipped with such a retaining element.

According to the invention, the device for maintaining a shoe on a sports apparatus includes a base designed to be secured to the sports apparatus, at least one maintaining strap including a covering portion of the upper part of the shoe and at least one retaining link connected to one of the lateral sides of the base. This maintaining device is characterized in that the maintaining strap includes an adjusting assembly as previously defined.

The retaining element connected to the maintaining device can have a degree of rotation from front to back of the base at its fastening point on the lateral sides of the base of the maintaining device.

The maintaining device can include two maintaining straps, one situated at the instep of the shoe and the other at the front of the shoe.

The invention also relates to a gliding board equipped with the maintaining device previously described that includes the adjusting assembly according to the invention.

These aims, features and advantages of the present invention will be better understood using the following description, in light of the appended drawings illustrating the invention, according to non-limiting embodiments.

FIG. 1 is a perspective view of a device for maintaining a support shoe, oriented on the outer side of the shoe, according to the invention.

FIG. 2 is a side view of a device for maintaining a snowboard shoe, seen from the inner side of the shoe, according to the invention.

FIG. 3 is a perspective view of the adjusting assembly, according to the invention, without the base of the blocking device.

FIG. 4 is a top view of the adjusting assembly of FIG. 3.

FIG. 5 is a bottom view of the adjusting assembly of FIG. 3.

FIG. 6 is a cross-sectional view of the adjusting assembly of FIG. 4 at the blocking element engaged with the retaining link, the blocking element being in the locked position, the base of the blocking device having been added.

FIG. 7 is a view of the retaining link shown alone according to the invention, in top view, showing its upper face.

FIG. 8 is a bottom view of the blocking lever according to the invention.

The invention is described using FIGS. 1 to 8.

As illustrated in FIG. 1, the retaining element designed for snowboarding is made up of a base 1 formed by a flat lower part designed to receive the sole of the shoe, surrounded by two lateral blanks (3, 4), the side wall 3 being positioned on the outer side of the shoe corresponding to the outer side of the user's foot. As long as the side wall 4 is positioned on the inner side of the corresponding shoe, the shoe not being shown in the figures. The base 1 is provided with a rear bearing element 2 for the shoe positioned behind base 1. This base is designed to be secured to a gliding board, in particular a snowboard, where both of the user's feet are fixed on that board. This base 1 includes two straps 5*a*, 5*b* for maintaining and tightening the shoe against the lower part of the base 1. Each of the maintaining straps 5*a*, 5*b* being made up of equivalent, but differently dimensioned parts, the description will only pertain to the strap 5*a*, called "instep strap", since it is designed to maintain the user's instep. By analogy, this description may be transposed to the strap 5*b*, or "front strap", designed to maintain the front part of the snowboard shoe.

The maintaining strap 5*a* is made up of three parts: a first retaining link formed by a rack 6 on the outer side of the shoe, a covering portion 7 designed to maintain the upper part of the shoe, and a retaining link 8 according to the invention situated on the inner side of the shoe.

On the outer side of the shoe, the rack is fastened to the outer lateral side of the base 1 by a screw 9 screwed in a hole positioned at one of the ends of the rack, the other free end 10 of the rack having been inserted inside a blocking and tightening device 11 that blocks the rack in the longitudinal position by cooperation with one of the teeth of this rack.

The covering portion 7 is made up of a wider part that makes it possible to cover the upper part of the shoe. This portion is made up of one or more layers made from more or less thick and flexible foams in order to ensure good comfort. Near its end situated at the outer side of the base 1, the covering portion 7 includes the blocking device 11, which is secured thereon. Near its end situated in the inner side of the base, the covering portion 7 includes, as illustrated in FIG. 2, a second locking element 12 in which the free end 13 of the retaining link 8 has been inserted, which maintains the retaining link 8 in longitudinal position by cooperation of the blocking device 12 in the opposite notching.

The retaining link 8 is also fixed on the inner lateral side 4 of the base by inserting a screw 15 at its fastening point 14 in the hole 14*a* and has a degree of rotation in the front-to-back direction of the base and vice versa at its fastening point 14 to adapt more easily to the incline of the upper face of the shoe.

The retaining link 8 according to the invention will be better understood by the description of FIGS. 3 to 8.

The retaining link 8 is in the form of a longilineal strip that has a series of notching element 16 that includes an upper part turned toward the outside of the base 1 and a lower part turned toward the shoe.

The notching element 16 is made up of two hollow zones 16*a* and 16*b* that are symmetrical relative to the longitudinal axis of symmetry of the retaining link 8. These hollows or recesses are formed in the upper part of the retaining link 8, in the thickness thereof.

The depth of the hollow is approximately 1 to 2 mm, while the maximum thickness of the retaining link 8 in strip form is 3 to 5 mm. Each of these hollows has a side emerging on the lateral sides of the retaining link 8.

The shape of the lower surface of each of the hollows is approximately rectangular, the side situated near the longitudinal axis of the retaining link being rounded. The shape of this hollow can have a variable shape, or the quadrilateral or oval type, and be adapted to the shape of the blocking elements 22*a*, 22*b* of the blocking device 12 designed to cooperate with the hollows 16*a*, 16*b*, respectively, of the notching element 16.

The series of notching elements 16 illustrated in these figures includes seven pairs of notching elements 16*a*, 16*b* distributed on the retaining link 8 homogenously. The positioning of the blocking device 12 in one of the notching pairs 16*a*, 16*b* makes it possible to choose the length of the retaining link 8 between its fastening point 14 and the blocking device 12 to press the covering portion 7 against the user's shoe.

At the longitudinal axis of symmetry of the retaining link, a central stiffening beam 17 of the retaining link 8 is made with a sufficient thickness making it possible to obtain an appropriate stiffness in longitudinal flexion and transverse stiffness. The section of the beam 17 is in particular visible in FIG. 6, while the zone occupied by this beam 17 is limited by the dotted lines shown in FIG. 7. This stiffening zone extends continuously from the first adjusting position 3 to the last adjusting position 24. The dimensioning of the central beam in terms of width l and height h makes it possible to keep sufficient flexion. This flexibility of the retaining link (8) is particularly interesting to allow the easy release of the shoe from the base (1) of the foot-maintaining device when putting the shoe on and removing it, when the retaining link (8) is in the unlocked position and tilted toward the outside of the base 1. The choice of the parameters h and l also makes it possible to keep enough rigidity in the transverse direction to avoid excessive transverse deformations or twisting or torsion effects. The beam 17 is also sized to ensure the mechanical strength of the retaining link 8.

The tightening strap 5*a* positioned at the instep has a retaining link 8 whose maximum width is comprised between 20 and 30 mm, preferably 24 mm, while the central beam 17 has a width comprised between 3 and 10 mm, preferably 5 mm, and a height comprised between 1.5 and 3 mm, preferably 2 mm.

The tightening strap 5*b* positioned at the front of the foot has a retaining link 8 with a shorter width than the width of the retaining link 8 of the tightening strap 5*a*, the central beam of this retaining link situated on the front of the foot being able to have the same dimensioning as that described for the tightening strap 5*a* of the instep, or optionally several millimeters less in height and/or width. The central stiffening zone can be compared to a beam or any other form meeting the stiffening conditions set out above.

The central stiffening zone 70 extends toward the two lateral sides of the retaining link 8 by lateral fins 25*a*, 25*b* situated between two successive pairs of hollows, these fins making it possible to add additional stiffness to the retaining link 8.

The thickness of the retaining link 8 at the fins can be equal to the thickness of the retaining link 8 at the stiffening beam 17 or can optionally have a smaller thickness, but still larger than the thickness of the retaining link 8 in the hollow zone 16*a* and 16*b*.

The width of the fins 25*a*, 25*b* in the longitudinal direction of the retaining link 8 is preferably greater than the width of the hollow zones 16*a*, 16*b*.

Furthermore, the retaining link 8 optionally has narrower zones over its length that are positioned at zones including the hollows 16*a*, 16*b*. These narrower zones are made by lateral recesses 18*a*, 18*b* produced on the lateral sides of the retaining link 8 that locally decrease the width of the retaining link 8. These narrower zones 18*a*, 18*b* are designed to receive the lateral stops 21*a*, 21*b*, which extend over the lower sides of the blocking element 11 of the blocking device 12. The stops 21*a* and 21*b* therefore block the retaining link 8 laterally in the transverse direction of the retaining link 8.

The retaining link 8 can be molded or injected and have a flat shape or a curved shape chosen such that this link more easily hugs the rounded shape of the upper part of the shoe.

The retaining link 8 previously described is designed to cooperate with the blocking device 12 by means of a pair of hollows 16*a*, 16*b* chosen by the user over the length of the retaining link. This blocking device 12 is made up of a lever 19 able to be actuated manually and mounted rotating around an axis d on the base 26 of this blocking device 12, this base 26 being shown only in FIG. 6. This lever 19 is generally situated on the side of the fastening point 14 of the retaining link 8 when the retaining link is positioned inside the blocking device 12 between the base 26 and the lever 19. The lever 19 is extended past the axis d by a blocker 20 that includes two blocking elements 22*a* and 22*b* that become embedded in the hollows 16*a* and 16*b* across from them in the locking position of the blocking element 12. The lateral stops 21*a* and 21*b* of the blocker 20 extend laterally past the blocking elements 22*a* and 22*b*, as illustrated in the sectional view of FIG. 6, to retain the retaining link 8 transversely and ensure centering thereof. As also illustrated in this FIG. 6, the retaining link 8 is therefore positioned between the base 26 of the blocking device 12 and the blocker 20 of the lever 19.

In order to unlock the blocking device 12, it is necessary to press manually on the lever 19 to tilt the blocker 20 and release it from the teeth or hollow zones 16*a*, 16*b*. The user can then move the retaining link 8 within the blocking device 12 and choose the longitudinal locking position that best suits him to adjust it to the proper length. He then releases the lever 19 to obtain the locked position, maintained automatically owing to a return spring, i.e., to engage the blocking element 22*a*, 22*b* in the hollows 16*a*, 16*b*. The total closure of the maintaining strap on the upper part of the shoe is done when the first retaining element 6 made up of a rack is engaged in the matching tightening loop 11, then adjusted to the proper length. Lastly, the covering portion 7 is tightened on the shoe by tightening the tightening loop 11, which cooperates with the rack 6.

In terms of dimensioning, the width (e) of the blocking elements 22*a*, 22*b* is approximately similar to the width c of the hollows of the retaining link 8, in the longitudinal direction thereof to block any play in the longitudinal direction. Furthermore, the contact surface between the blocking elements 22*a*, 22*b* and the hollows 16*a*, 16*b* is large in order to decrease the pressure exerted by the blocking element 12 on the retaining link 8. The contact surface is preferably larger than 30 $mm^2$ for a retaining link 8 dimensioned for an instep tightening strap.

The concept of the invention, as implemented by the embodiment described above, makes it possible to obtain a strap for maintaining a shoe on a sports apparatus provided with an adjusting assembly that has the following advantages:

- This maintaining strap is easily adapted to the shoe due to the use of a blocking device that can be actuated manually and locking positions, spaced apart from one another over the length of the retaining link.
- The stiffness of the retaining link is optimized owing to the dimensioning, in terms of width and thickness, of the central stiffening zone in the direction keeping flexibility in longitudinal flexion and sufficient stiffening in transverse flexion.
- The pressures exerted by the blocking device on the retaining link are significantly decreased relative to the existing systems in the prior art.

Naturally, the invention is not limited to the described embodiment.

In particular, the maintaining strap as described including the adjusting assembly according to the invention has been described in three parts, on element for maintaining a snowboard shoe, also called snowboard fastener. This strap could be made up of only two parts, or various elements including at least one adjusting assembly according to the invention. The retaining link can be made from a single appropriate material, or from several materials. The blocking element could also have another, more complex kinematic corresponding to the varied tightening loops existing in the prior art, the blocker element having the particularities previously described.

Of course, the adjusting assembly according to the invention could be used on a maintaining element for a shoe designed to be secured to another type of gliding board on snow or water.

In the case of a snowboard in particular, the board will be equipped with two maintaining elements designed to receive both of the user's feet, respectively.

The invention claimed is:

1. An adjusting assembly designed to retain a shoe on a sports apparatus comprising: a shoe retaining device, the shoe retaining device including a retaining link and a blocking device, this retaining link having a fastening point at one of these ends and a free end at the other end designed to be inserted into the blocking device, the retaining link including notching elements designed to cooperate with the blocking device when it is in the locking position in order to adjust the length of the retaining link, wherein the notching elements are made up of at least two hollows zones distributed on either side of a longitudinal stiffening zone of the retaining link and in that the blocking device comprises a lever articulated around an axis and including two blocking elements that cooperate with said hollow zones, respectively, of the retaining link in its locking position.

2. The adjusting assembly according to claim 1, wherein the stiffening zone is situated in the central portion of the retaining link around the longitudinal axis of symmetry of said link.

3. The adjusting assembly according to claim 1, wherein the stiffening zone is situated on the longitudinal axis of symmetry of the retaining link.

4. The adjusting assembly according to claim 1, wherein the stiffening zone extends continuously from the first adjusting position to the last adjusting position.

5. The adjusting assembly according to claim 1, wherein the stiffening zone is extended by two lateral fins on either side thereof each situated between two successive hollows.

6. The adjusting assembly according to claim 5, wherein the width of the fins is greater than the width of the hollows zones.

7. The adjusting assembly according to claim 1, wherein the blocking device includes centering teeth on either side of the blocking elements that are positioned on either side of the hollow zones of the retaining link in the locking position of the blocking device.

8. The adjusting assembly according to claim 7, wherein the retaining link includes lateral recesses formed on the lateral sides of the retaining link and that are designed to receive the centering teeth of the blocking device.

9. A device for maintaining a shoe on a sports apparatus including a base designed to be secured to the sports apparatus, at least one maintaining strap including a covering portion of the upper part of the shoe and at least one retaining link connected to one of the lateral sides of the base, wherein the maintaining strap includes an adjusting assembly according to claim 1.

10. The maintaining device for a shoe according to claim 9, wherein the retaining element has a degree of rotation from front to back of the base at its fastening point on the lateral sides of the base.

11. The maintaining device for a shoe according to claim 9, wherein it includes two maintaining straps, one situated at the instep of the shoe and the other at the front of the shoe.

12. A gliding board comprising at least one device for maintaining a shoe according to claim 9.

* * * * *